US008901832B2

(12) United States Patent
Qiu et al.

(10) Patent No.: US 8,901,832 B2
(45) Date of Patent: Dec. 2, 2014

(54) LED DRIVER SYSTEM WITH DIMMER DETECTION

(75) Inventors: Weihong Qiu, San Ramon, CA (US); Rakesh Anumula, Sunnyvale, CA (US); Fred F. Greenfeld, Nederland, CO (US)

(73) Assignee: Intersil Americas LLC, Milpitas, CA (US)

( * ) Notice: Subject to any disclaimer, the term of this patent is extended or adjusted under 35 U.S.C. 154(b) by 127 days.

(21) Appl. No.: 13/536,892

(22) Filed: Jun. 28, 2012

(65) Prior Publication Data

US 2013/0207555 A1 Aug. 15, 2013

Related U.S. Application Data

(60) Provisional application No. 61/598,281, filed on Feb. 13, 2012.

(51) Int. Cl.
*H05B 37/00* (2006.01)

(52) U.S. Cl.
USPC ..... 315/186; 315/256; 315/201; 315/284; 315/294; 315/200 R

(58) Field of Classification Search
CPC ..... H02J 7/00; H02P 27/05; H05B 33/0815
USPC ..... 315/186, 201, 294, 200 R, 206, 223, 315/224, 151, 307, 297, 291, 308, 247, 246, 315/225, 284, 256; 318/400.3; 320/107
See application file for complete search history.

(56) References Cited

U.S. PATENT DOCUMENTS

2008/0169787 A1* 7/2008 Hsieh ..... 320/128
2011/0043133 A1* 2/2011 Van Laanen et al. ..... 315/294
2012/0081818 A1* 4/2012 Mazumdar ..... 361/23

OTHER PUBLICATIONS

Brown, R. et al. "PFC Converter Design with IR1150 One Cycle Control IC" Application Note AN-1077. International Rectifier v 2.3, Jun. 2005, pp. 1-18.

* cited by examiner

*Primary Examiner* — Douglas W Owens
*Assistant Examiner* — Jae Kim
(74) *Attorney, Agent, or Firm* — Gary Stanford

(57) ABSTRACT

An LED driver system including an input receiving a rectified AC conductive angle modulated voltage on a rectified node, a converter, a low-pass filter, and AC detector, and a driver network. The converter is coupled to the rectified node and includes a power switching device coupled to a switching node, in which the power switching device is controlled to convert the rectified AC conductive angle modulated voltage to an output voltage and output current. The low-pass filter is configured to filter voltage of the switching node to provide a filtered voltage. The AC detector receives the filtered voltage and provides a current sense signal indicative thereof. The driver network controls duty cycle of the power switching device based on the current sense signal.

17 Claims, 4 Drawing Sheets

LED DRIVER SYSTEM WITH DIMMER DETECTION

CROSS-REFERENCE TO RELATED APPLICATIONS

This application claims the benefit of U.S. Provisional Application Ser. No. 61/598,281, filed on Feb. 13, 2012, which is hereby incorporated by reference in its entirety for all intents and purposes.

BRIEF DESCRIPTION OF THE DRAWINGS

The benefits, features, and advantages of the present invention will become better understood with regard to the following description and accompanying drawings, in which.

DETAILED DESCRIPTION

The benefits, features, and advantages of the present invention will become better understood with regard to the following description, and accompanying drawings. The following description is presented to enable one of ordinary skill in the art to make and use the present invention as provided within the context of a particular application and its requirements. Various modifications to the preferred embodiment will, however, be apparent to one skilled in the art, and the general principles defined herein may be applied to other embodiments. Therefore, the present invention is not intended to be limited to the particular embodiments shown and described herein, but is to be accorded the widest scope consistent with the principles and novel features herein disclosed.

Light-emitting diode (LED) lighting is becoming more popular. In order for an LED light (including one or more LED elements) to be used to replace an incandescent bulb, the LED light should be able to work with conventional line dimmers for brightness control. Typical line dimmers are implemented using TRIAC circuits or the like which block some portion of the AC line voltage. To control brightness of the LED light, an LED driver monitors the conduction angle of the line dimmer and converts this information to a current reference signal used to adjust current through the LED light.

Figure 1:
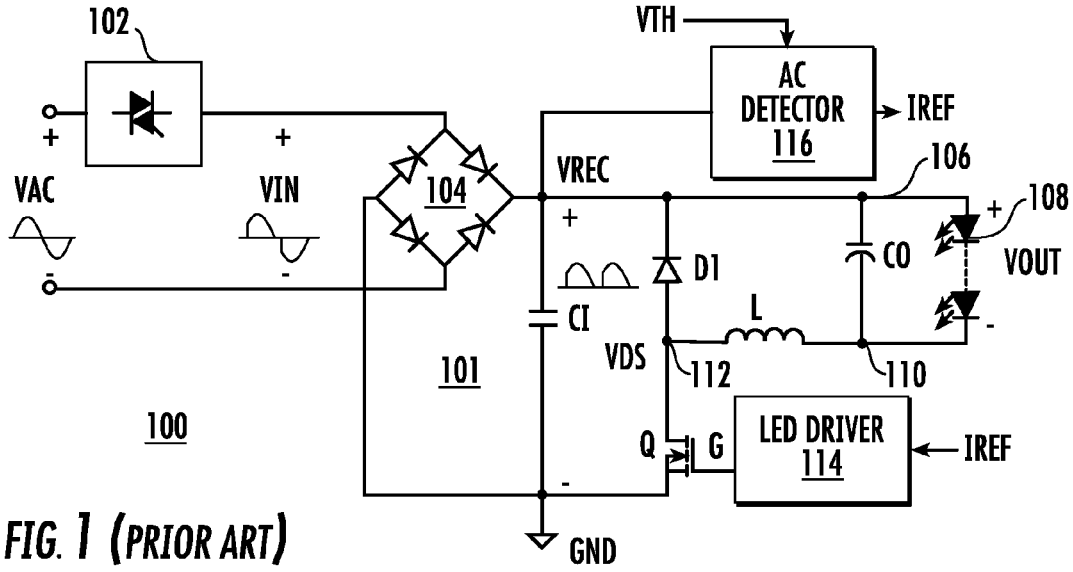
FIG. 1 (PRIOR ART)
FIG. 1 is a schematic and block diagram of a conventional LED driver with dimmer detection for providing current to an LED light.

FIG. 1 is a schematic and block diagram of a conventional LED driver system 100 with dimmer detection for providing current to an LED "light" 108 including one or more individual LED elements coupled in series. In this case, an adjustable line dimmer 102 receives an input AC line voltage VAC and provides an AC conductive angle modulated voltage or "chopped" differential voltage VIN, which is provided to a pair of inputs of a full-wave bridge rectifier 104. The rectifier 104 has a pair of output terminals providing a rectified voltage VREC on a node 106 relative to a common node at the input of a converter 101. The common node is shown as ground (GND), which may be any positive, negative or ground voltage level.

In the illustrated embodiment, the converter 101 is configured as a buck type converter which converts VREC having a higher voltage level to VOUT having a lower voltage level. The converter 101 includes an input filter capacitor C1 coupled between node 106 and GND. Node 106 is further coupled to a cathode of a diode D1, to one end of an output capacitor CO and to one end of the LED light 108. The other end of the LED light 108 is coupled to a node 110, which is further coupled to the other end of CO and to one end of an inductor L. An output voltage VOUT is developed across the LED light 108. The other end of the inductor L is coupled to a node 112, which is further coupled to the anode of diode D1 and to the drain of a power switching device Q. The source of Q is coupled to GND and its gate receives a gate control signal G from an LED driver 114. An AC detector 116 compares the voltage of VREC with a fixed threshold voltage VTH and develops a current sense signal IREF provided to an input of the LED driver 114.

The power switching device Q is shown as a metal-oxide semiconductor, field-effect transistor (MOSFET), although similar forms may be used (e.g., FETs, MOS devices, etc.) or other types of transistors or may be used, such as bipolar junction transistors (BJTs) and the like, insulated-gate bipolar transistors (IGBTs) and the like, etc. VAC may have a peak amplitude of approximately 180-200 Volts (V) or the like.

Figure 2:
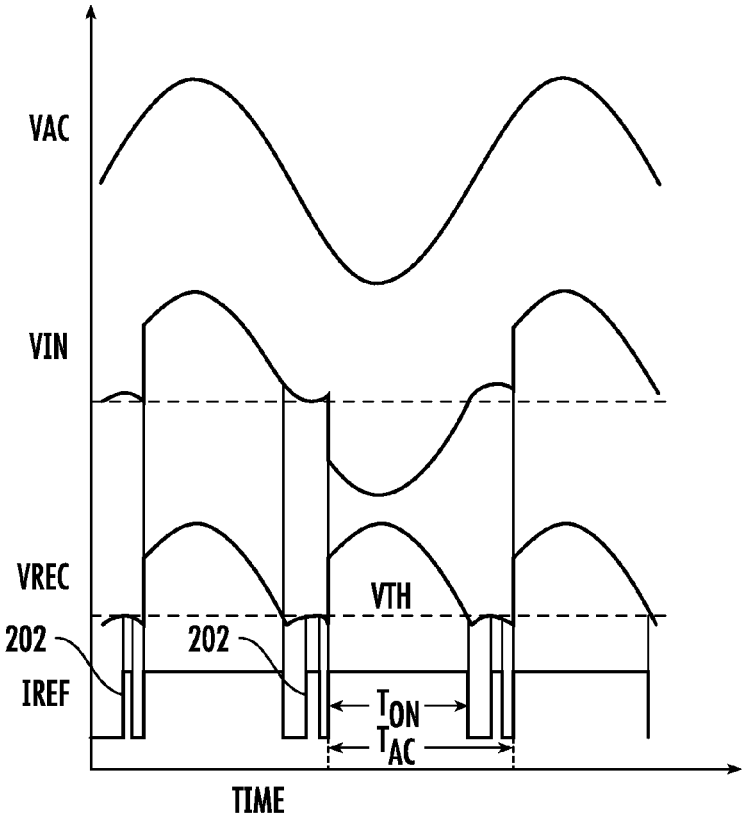
FIG. 2 (PRIOR ART)
FIG. 2 is a timing diagram which plots signals of the conventional LED driver of FIG. 1 versus time illustrating its operation.

FIG. 2 is a timing diagram which plots VAC, VIN, VREC and IREF versus time illustrating operation of the conventional LED driver system 100. In one embodiment, the line dimmer 102 is adjustable to chop one or both of the leading edge and the trailing edge of VAC at a selected phase angle between 0 and 180 degrees for every half cycle (i.e., 180 degrees), to provide VIN as an AC conductive angle modulated voltage. In one embodiment, the line dimmer 102 uses a TRIAC or the like to delay the VAC wave shape near zero until a predetermined phase angle selected according to the dimmer adjustment. The greater the selected dimmer phase angle, the more VIN is chopped or zeroed to reduce the voltage of VIN. Once the phase angle is reached for each half cycle, VIN steps up to the line voltage (e.g., the TRIAC conducts) and the remaining portion of VAC is output to the converter 101 until the next half cycle.

The rectifier 104 rectifies VIN to provide VREC in which negative going excursions of VIN are converted to positive going excursions of VREC. VTH is a predetermined or fixed DC voltage related to VREC. In one embodiment, VTH has a voltage level of about 2% of VREC, such as about 1 to 4 V. The AC detector 116 asserts IREF low when VREC is below VTH and asserts IREF high when VREC rises above VTH. Thus, IREF develops edges that correspond to crossings of VREC with VTH. Ideally, IREF develops an on-time $T_{ON}$ that begins when VREC rises above VTH and that ends when VREC falls below VTH, in which IREF should be low for the remainder of each VREC period, shown as $T_{AC}$.

In the ideal configuration, the converter 101 drives the LED light 108 with a current that is proportional to the duty cycle (D) of VREC and thus proportional to the duty cycle of IREF, where $D=T_{ON}/T_{AC}$. The higher the duty cycle, the higher the current through the LED light 108, and thus the brighter the LED light 108. The LED driver 114 detects the duty cycle of IREF and develops a corresponding duty cycle of the gate drive signal G to drive Q to develop the current through the LED light 108. The LED driver 114 toggles Q on and off at a selected switching frequency FSW and at a duty cycle based on IREF to adjust the brightness of the LED light 108. FSW may be any suitable frequency level such as tens or hundreds of kilohertz (KHz).

Ideally, the line dimmer 102 does not conduct at all during the chopped portion of VAC so that VIN is zero and otherwise conducts with very little impedance so that VIN follows VAC for the remainder of each cycle. Many practical line dimmers, however, do not hold voltage tightly in its off state which results in noise distortion of VIN. The distortion of VIN is reflected as corresponding distortion of VREC during the chopped portion of VIN when VREC is intended to be zero. The distortion, in turn, results in non-zero noise on VREC in which VREC may rise above VTH during the off portion of the cycle. These distortions may cause undesired spurious pulses 202 of IREF, which correspondingly causes changes of switching of Q (based on an internal DC reference voltage which moves or ripples) causing undesired flicker of the LED light 108 noticeable to the human eye.

The magnitude of VTH may be increased to reduce or eliminate the spurious pulses 202 of IREF to minimize or eliminate flicker. Increasing VTH, however, decreases the power factor and overall efficiency and increases the harmonic distortion of LED current. It is desired to eliminate the undesired flickering without introducing any of these additional undesired consequences.

Figure 3:
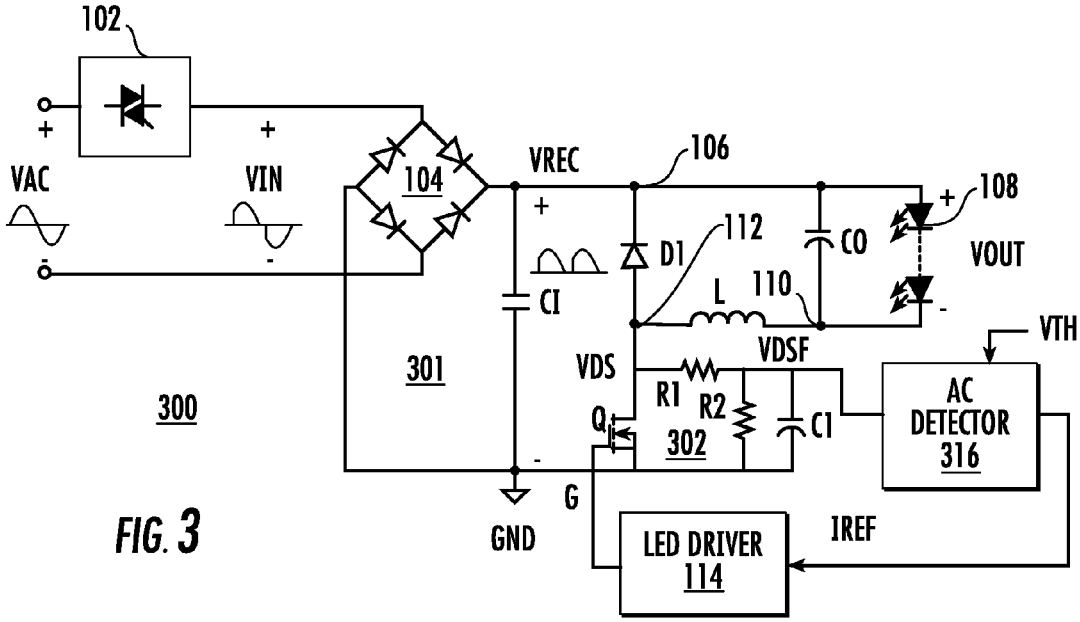
FIG. 3 is a schematic and block diagram of an LED driver with dimmer detection implemented according to one embodiment for providing current to the LED light without introducing spurious noise causing flicker, without decreasing the power factor or overall efficiency, and without increasing harmonic distortion.

FIG. 3 is a schematic and block diagram of an LED driver system 300 with dimmer detection implemented according to one embodiment for providing current to the LED light 108 without introducing spurious noise causing flicker, without decreasing the power factor or overall efficiency, and without increasing harmonic distortion. Similar components as those of the conventional LED driver system 100 have identical reference numbers. The line dimmer 102 and the rectifier 104 provide VREC on node 106 in similar manner, and components CI, D1, CO, L and Q are coupled in a similar manner of a buck converter 301. The AC detector 116, however, is replaced by a low-pass filter 302 and AC detector 316, in which the low-pass filter 302 interfaces the VDS voltage rather than VREC. In this embodiment, the low-pass filter 302 includes resistors R1 and R2 and a capacitor C1. R1 has one end coupled to node 112 developing VDS, and its other end coupled to one end of R2, to one end of C1 and to an input of the AC detector 316. The other ends of R2 and C1 are coupled to GND. The common junction of R1, R2 and C1 develop a filtered VDS signal VDSF provided to the AC detector 316. The AC detector 316 compares VDSF with VTH for developing the IREF signal in a similar manner as previously described. Since the AC detector 316 is monitoring a filtered version of VDS, however, the spurious noise issues are eliminated as further described herein.

Figure 4:
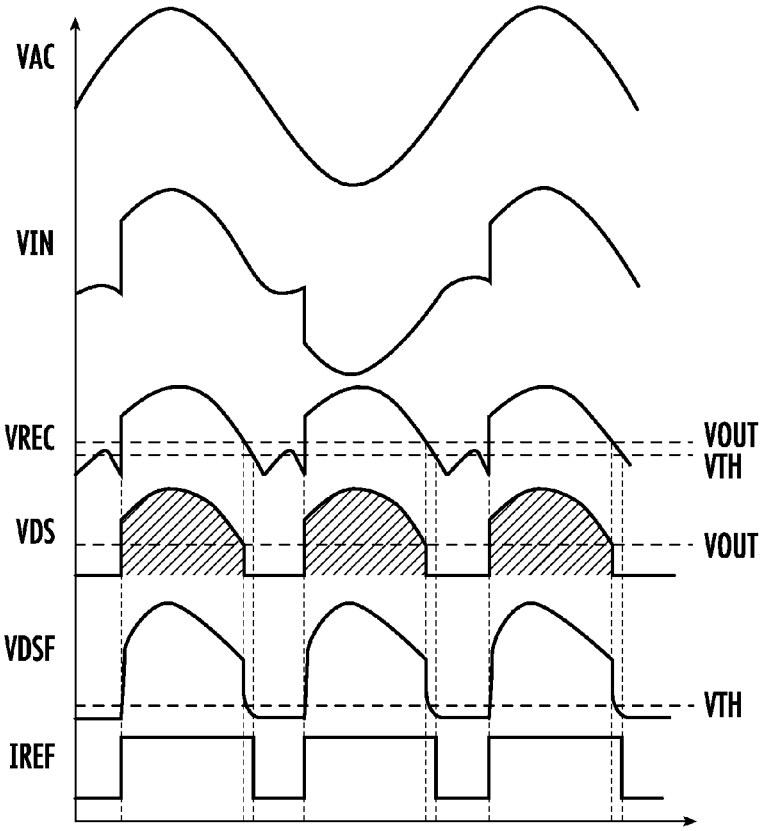
FIG. 4 is a timing diagram which plots signals of the LED driver of FIG. 3 versus time illustrating its operation.

FIG. 4 is a timing diagram which plots VAC, VIN, VREC VDS, VDSF and IREF versus time illustrating operation of the LED driver system 300. VAC, VIN and VREC are plotted with substantially the same waveform configurations in which VIN and VREC include the distortions caused by the line dimmer 102 among other circuit components. The voltage level of VTH is plotted with VDS. As before, the distortions cause VREC to rise above VTH which would cause spurious pulses of IREF in the conventional configuration. It is noted, however, that the noise pulses on VREC do not rise to the level of VOUT, which may be several tens of volts (e.g., 30V) depending upon the particular configuration.

In operation, when VREC is below the voltage level of VOUT, the internal body diode of Q may conduct even when Q is off. VDS remains at about 0V give or take a diode voltage drop, and does not rise to the level of VTH or VOUT. When VREC rises above VOUT, VDS rises to about the voltage level of VREC. The voltage of VDSF through the low-pass filter 302 rises above VTH relatively quickly and the AC detector 316 asserts IREF high. The LED driver 114 continues toggling operation of Q at FSW, in which the voltage of VDS toggles accordingly which is illustrated using diagonal lines. The low-pass filter 302 filters out the higher carrier frequency of operation of VDS so that VDSF provides envelope information of VDS while VREC is above VOUT.

When VREC falls below VOUT, VDS goes to zero. VDSF decays to zero based on the time constant of C1 and the parallel combination of R1 and R2 and decays below VTH soon thereafter. When VDSF falls below VTH, the AC detector 316 asserts IREF back low and VDSF falls to about zero. VDS remains at about zero and below VOUT, and VDSF remains at about zero an below VTH. Thus, IREF remains low during the remainder of the cycle. In this manner, spurious pulses on IREF are eliminated in spite of noise pulses on VREC.

Figure 5:
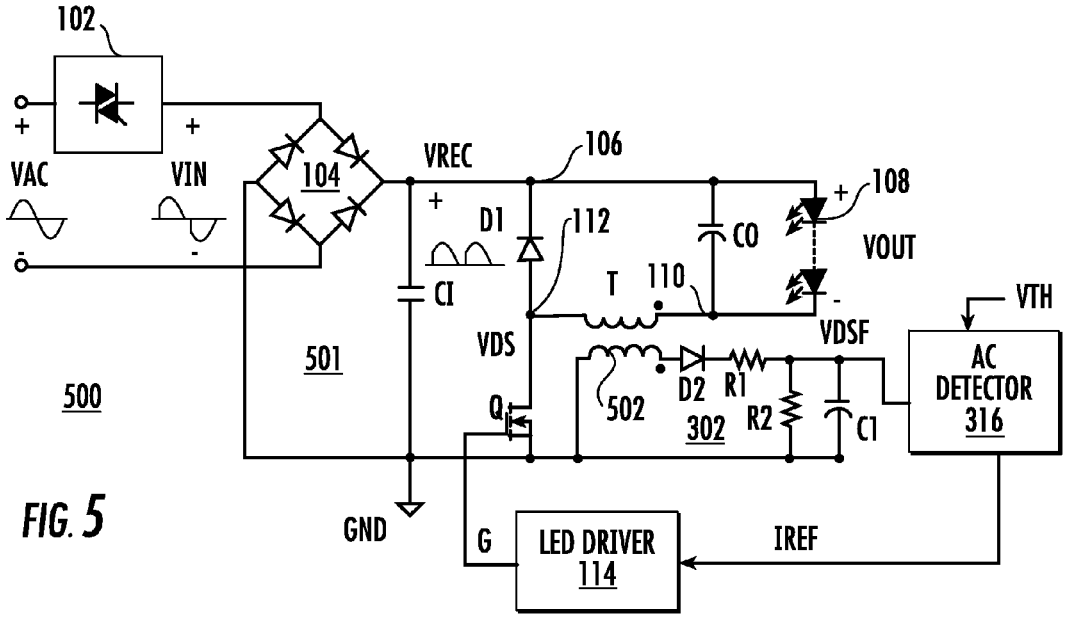
FIG. 5 is a schematic and block diagram of an LED driver with dimmer detection implemented according to another embodiment for providing current to the LED light without introducing spurious noise causing flicker, without decreasing the power factor or overall efficiency, and without increasing harmonic distortion.

FIG. 5 is a schematic and block diagram of an LED driver system 500 with dimmer detection implemented according to another embodiment for providing current to the LED light 108 without introducing spurious noise causing flicker, without decreasing the power factor or overall efficiency, and without increasing harmonic distortion. Similar components as those of the LED driver system 300 have identical reference numbers. The line dimmer 102 and the rectifier 104 provide VREC on node 106 in similar manner, and components CI, D1, CO, and Q are coupled in a similar manner of another buck converter 501. In this case, the inductor L is replaced by a transformer T having a primary winding coupled between nodes 110 and 112 with its dotted end coupled to node 110. The transformer T has a secondary winding 502 having its undotted end coupled to GND and its dotted end coupled to the anode of a diode D2. The cathode of D2 is coupled to one end of R1, in which R2, C1 and the AC detector 316 are coupled to the other end of R1 in similar manner. The AC detector 316 provides IREF to the LED driver 114 in similar manner, which develops G to drive Q at a corresponding duty cycle in similar manner previously described.

Operation is substantially similar to the LED driver system 300. When VREC is below VOUT, VDS is zero and current through the primary winding of the transformer T goes to zero or near zero even while Q is switching. The secondary winding develops zero or no voltage pulling VDSF to zero. When VREC rises above VOUT, current flowing in the primary winding of the transformer T caused by switching results a corresponding voltage in the secondary winding 502 causing VDSF to rise accordingly, and the AC detector 316 asserts IREF high. When VREC falls below VOUT, VDS goes to zero and the current through the transformer T goes to zero so that VDSF falls to zero according to the RC time constant. When VDSF falls below VTH, the AC detector 316 pulls IREF back low.

Figure 6:
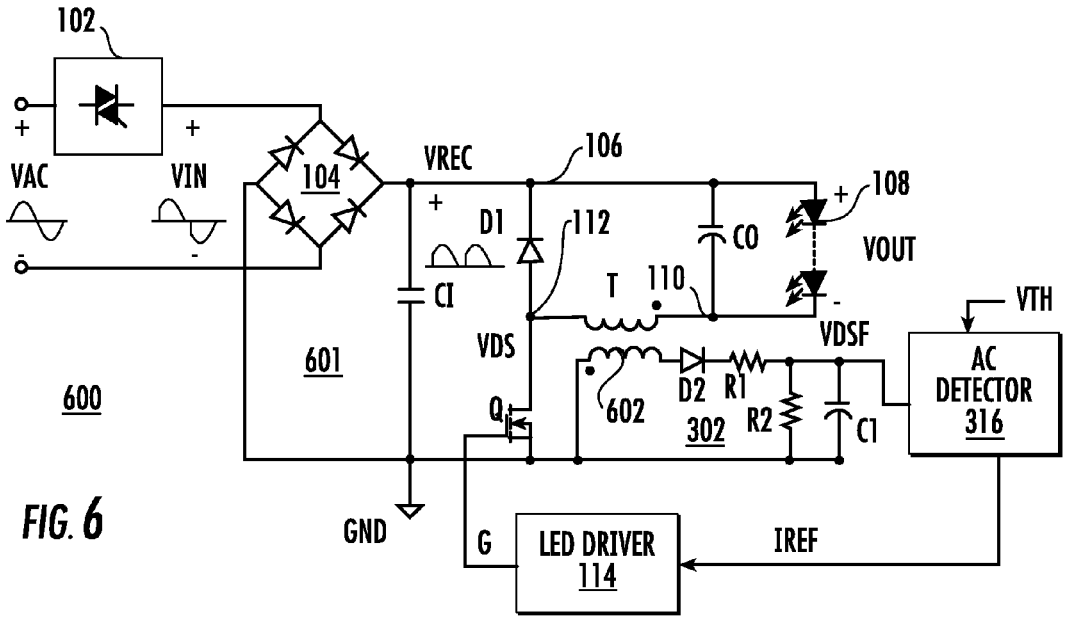
FIG. 6 is a schematic and block diagram of a dimmer circuit implemented according to another embodiment for providing current to the LED light without introducing spurious noise causing flicker, without decreasing the power factor or overall efficiency, and without increasing harmonic distortion.

FIG. 6 is a schematic and block diagram of an LED driver system 600 with dimmer detection implemented according to another embodiment for providing current to the LED light 108 without introducing spurious noise causing flicker, without decreasing the power factor or overall efficiency, and without increasing harmonic distortion. The LED driver system 600 is configured and operates in substantially similar manner as the LED driver system 500. The only difference is that the polarity of the secondary winding of the transformer T of converter 601, shown as secondary winding 602, is reversed compared to the secondary winding 502. Operation is substantially similar.

A potential advantage of the LED driver systems 500 and 600 is that the transformer T allows the voltage level of VDSF to be significantly smaller, and VTH is scaled accordingly.

Figure 7:
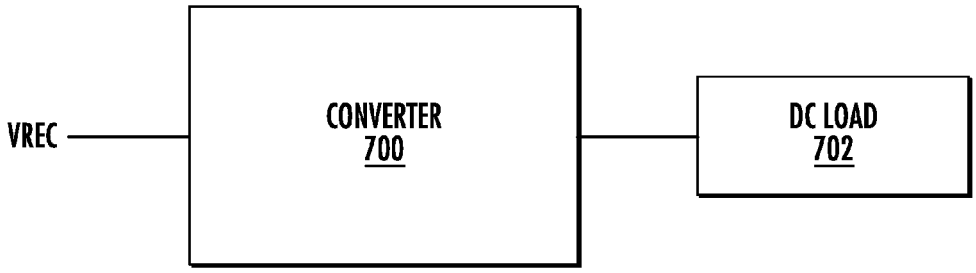
FIGS. 7-9 illustrate various electronic devices using the converter implemented according to any of the configurations described herein illustrating alternative type uses.
Figure 8:
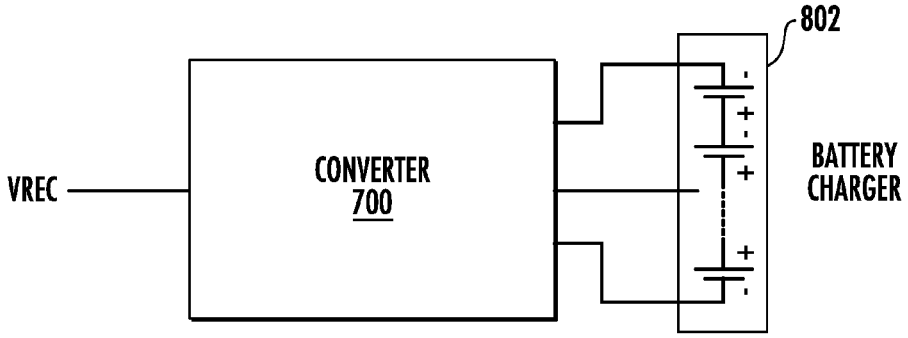
Figure 9:
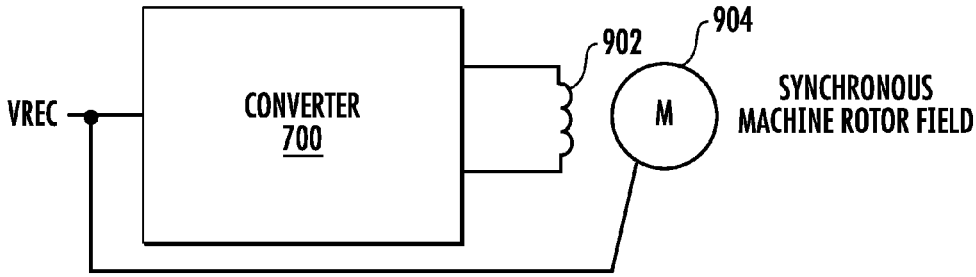

FIGS. 7-9 illustrate various electronic devices using a converter 700 implemented according to any of the configurations described herein, such as converters 301, 501 or 601, illustrating alternative type uses. As shown in FIG. 7, the converter 700 receives VREC and drives any type of DC load 702. As shown in FIG. 8, the converter 700 receives VREC and charges a battery or battery bank 802 including one or more rechargeable batteries. As shown in FIG. 9, the converter 700 receives VREC and provides current to a coil 902 or the like to generate a magnetic field for an electric motor 904 or the like.

Although the present invention has been described in considerable detail with reference to certain preferred versions thereof, other versions and variations are possible and contemplated. Those skilled in the art should appreciate that they can readily use the disclosed conception and specific embodiments as a basis for designing or modifying other structures for providing the same purposes of the present invention without departing from the spirit and scope of the invention as defined by the following claim(s).

The invention claimed is:

1. An LED driver system, comprising:

an input receiving a rectified AC conductive angle modulated voltage on a rectified node;

a converter coupled to said rectified node and including a power switching device coupled to a switching node, wherein said power switching device is controlled to toggle voltage of said switching node between a low voltage level to said rectified AC conductive angle modulated voltage and to convert said rectified AC conductive angle modulated voltage to an output voltage and an output current;

a low-pass filter configured to filter said voltage of said switching node to provide a filtered voltage having a duty cycle indicative of a conduction angle of said rectified AC conductive angle modulated voltage;

an AC detector which receives said filtered voltage and provides a current sense signal indicative of said duty cycle of said filtered voltage; and a driver network which controls said power switching device based on said current sense signal.

2. The LED driver system of claim 1, wherein said converter toggles said power switching device at a duty cycle based on said duty cycle of said filtered voltage.

3. The LED driver system of claim 1, wherein said power switching device comprises a MOSFET.

4. The LED driver system of claim 1, wherein said converter comprises:

a MOSFET configured as said power switching device having a drain coupled to said switching node and a source coupled to a reference node;

an input capacitor coupled between said rectifier node and said reference node;

a first diode having an anode coupled to said switching node and a cathode coupled to said rectifier node;

an output capacitor having a first end coupled to said rectifier node and a second end coupled to an output node; and an inductor coupled between said output node and said switching node.

5. The LED driver system of claim 1, wherein said low-pass filter comprises a resistor-capacitor filter.

6. The LED driver system of claim 1, wherein said low-pass filter comprises a resistor-capacitor filter configured to provide envelope information of voltage of said switching node.

7. The LED driver system of claim 1, further comprising:

a dimmer receiving an AC voltage and providing an AC conductive angle modulated voltage; and a full-wave bridge rectifier having an input receiving said AC conductive angle modulated voltage and having an output coupled to said rectified node for providing said rectified AC conductive angle modulated voltage.

8. An electronic device, comprising:

a dimmer receiving an AC voltage and providing an AC conductive angle modulated voltage; and a full-wave bridge rectifier having an input receiving said AC conductive angle modulated voltage and having an output providing a rectified AC conductive angle modulated voltage; and a converter, comprising:

a rectified node receiving said rectified AC conductive angle modulated voltage;

a power switching device coupled to a switching node, wherein said power switching device is controlled to toggle voltage of said switching node between a low voltage level to said rectified AC conductive angle modulated voltage and to convert said rectified AC conductive angle modulated voltage to an output voltage across and current through a pair of output nodes;

a low-pass filter configured to filter said voltage of said switching node to provide a filtered voltage having a duty cycle indicative of a conduction angle of said rectified AC conductive angle modulated voltage;

an AC detector which receives said filtered voltage and provides a current sense signal indicative of said duty cycle of said filtered voltage; and a driver network which controls said power switching device based on said current sense signal.

9. The electronic device of claim 8, further comprising a DC load coupled to said pair of output nodes.

10. The electronic device of claim 9, wherein said DC load comprises at least one LED.

11. The electronic device of claim 9, wherein said DC load comprises a battery charger.

12. The electronic device of claim 9, wherein said DC load comprises a synchronous motor.

13. The electronic device of claim 9, wherein said converter comprises:

a MOSFET configured as said power switching device having a drain coupled to said switching node and a source coupled to a reference node;

an input capacitor coupled between said rectifier node and said reference node;

a first diode having an anode coupled to said switching node and a cathode coupled to said rectifier node;

an output capacitor having a first end coupled to said rectifier node and a second end coupled to an output node; and an inductor coupled between said output node and said switching node.

14. The electronic device of claim 9, wherein said low-pass filter comprises a resistor-capacitor filter.

15. The electronic device of claim 9, wherein said low-pass filter comprises a resistor-capacitor filter configured to provide envelope information of said voltage of said switching node.

16. A method of detecting a dimming angle of an LED driver which receives a rectified AC conductive angle modulated voltage and which controls a switching device to convert the rectified AC conductive angle modulated voltage to current through an LED light, comprising:

sensing voltage across the switching device and providing a filtered voltage comprising envelope information of the sensed voltage in which said envelope information is indicative of a conduction angle of the rectified AC conductive angle modulated voltage;

comparing the filtered voltage information with a predetermined threshold for providing a current sense signal indicative the conduction angle; and using the current sense signal to control switching of the switching device.

17. The method of claim 16, further comprising controlling an LED driver which toggles the switching device at a duty cycle based on the current sense signal.

* * * * *